US007923914B2

(12) United States Patent
Hao et al.

(10) Patent No.: US 7,923,914 B2
(45) Date of Patent: Apr. 12, 2011

(54) FIELD EMISSION CATHODE DEVICE AND FIELD EMISSION DISPLAY USING THE SAME

(75) Inventors: Hai-Yan Hao, Beijing (CN); Li Qian, Beijing (CN); Peng Liu, Beijing (CN); Liang Liu, Beijing (CN); Qi Cai, Beijing (CN); Shou-Shan Fan, Beijing (CN)

(73) Assignees: Tsinghua University, Beijing (CN); Hon Hai Precision Industry Co., Ltd., Tu-Cheng, New Taipei (TW)

( * ) Notice: Subject to any disclaimer, the term of this patent is extended or adjusted under 35 U.S.C. 154(b) by 172 days.

(21) Appl. No.: 12/352,650

(22) Filed: Jan. 13, 2009

(65) Prior Publication Data

US 2010/0019647 A1 Jan. 28, 2010

(30) Foreign Application Priority Data

Jul. 25, 2008 (CN) ..... 2008 1 0142525

(51) Int. Cl.
*H01J 1/62* (2006.01)

(52) U.S. Cl. ..... 313/495; 313/309; 313/336; 313/351

(58) Field of Classification Search ..... 313/309, 313/336, 351, 495–497
See application file for complete search history.

(56) References Cited

U.S. PATENT DOCUMENTS

2005/0057168 A1 3/2005 Song et al.

FOREIGN PATENT DOCUMENTS

CN 1598999 A 3/2005

*Primary Examiner* — Joseph L Williams
(74) *Attorney, Agent, or Firm* — D. Austin Bonderer

(57) ABSTRACT

The field emission cathode device includes an insulating substrate with a number of cathodes mounted thereon. A number of field emission units are mounted on the cathodes. A dielectric layer is disposed on the insulating substrate and defines a number of voids corresponding to the field emission units. The dielectric layer has an upper and lower section and disposed on the insulating substrate. The dielectric layer defining a plurality of voids corresponding to the field emission units. A number of grids disposed between the upper and lower sections, and wherein each grid are secured by the upper and lower sections of the dielectric layer.

20 Claims, 5 Drawing Sheets

FIELD EMISSION CATHODE DEVICE AND FIELD EMISSION DISPLAY USING THE SAME

BACKGROUND

1. Technical Field

The disclosure relates to field emission displays and, specifically, to a field emission cathode device and display using the device.

2. Discussion of Related Art

Field emission displays (FEDs) are a new, rapidly developing flat panel display technology. Compared to conventional technologies, such as cathode-ray tube (CRT) and liquid crystal display (LCD) technologies, FEDs are superior in providing a wider viewing angle, lower energy consumption, smaller size, and higher quality. In particular, carbon nanotube-based FEDs (CNTFEDs) have attracted much attention in recent years.

Generally, FEDs can be roughly classified into diode and triode structures. Diode structures have only one cathode electrode and only one anode electrode, and are only suitable for displaying characters, not for applications requiring high resolution. The diode structures require high voltage, produce relatively non-uniform electron emissions, and require relatively costly driving circuits. Triode structures were developed from diode structures by adding a gate electrode for controlling electron emission. Triode structures can emit electrons at relatively lower voltages.

Referring to FIGS. 4 and 5, a triode field emission cathode device 100, according to the prior art, is disclosed. The field emission cathode device 100 includes an insulating substrate 102, a number of longitudinal cathodes 104 attached on the substrate 102, a number of field emission units 110 distributed on the cathodes 104, a dielectric layer 106, and a number of gate electrodes 108 directly mounted on the top of the dielectric layer 106. The cathodes 104 are spaced and parallel. The field emission units 110 are arranged in series on the cathodes 104. The field emission units 110 are electrically connected to the cathodes 104 and have a number of field emitters mounted thereon. The dielectric layer 106 includes a number of through holes 116 exposing the cathodes 104 and the field emission units 110. An axis of the gate electrode 108 is perpendicular to that of the cathodes 104. Due to detachability between the gate electrodes 108 and the dielectric layer 106, the gate electrodes 108 are prone to sliding and deformation relative to the dielectric layer 106 during packaging of the field emission cathode device 100. In addition, during operation of the field emission cathode device 100, the gate electrodes 108 are easily distorted by the electric field, which results in a short circuit between the cathodes 104 and the gate electrodes 108. Therefore, the distance between the cathodes 104 and the gate electrodes 108 cannot be too short, and preferably exceed 20 microns (μm). However, as the distance between the cathodes 104 and the gate electrodes 108 increases, working voltage of the gate electrodes 108 must increase accordingly. The high working voltage affects the field emission performance of the field emission cathode device 100.

What is needed, therefore, is a field emission cathode device and a field emission display with lower working voltage and a higher field emission performance.

BRIEF DESCRIPTION OF THE DRAWINGS

Many aspects of the present field emission cathode device and field emission display can be better understood with reference to the following drawings. The components in the drawings are not necessarily drawn to scale, the emphasis instead being placed upon clearly illustrating the principles of the present field emission cathode device and a field emission displays.

Figure 1:
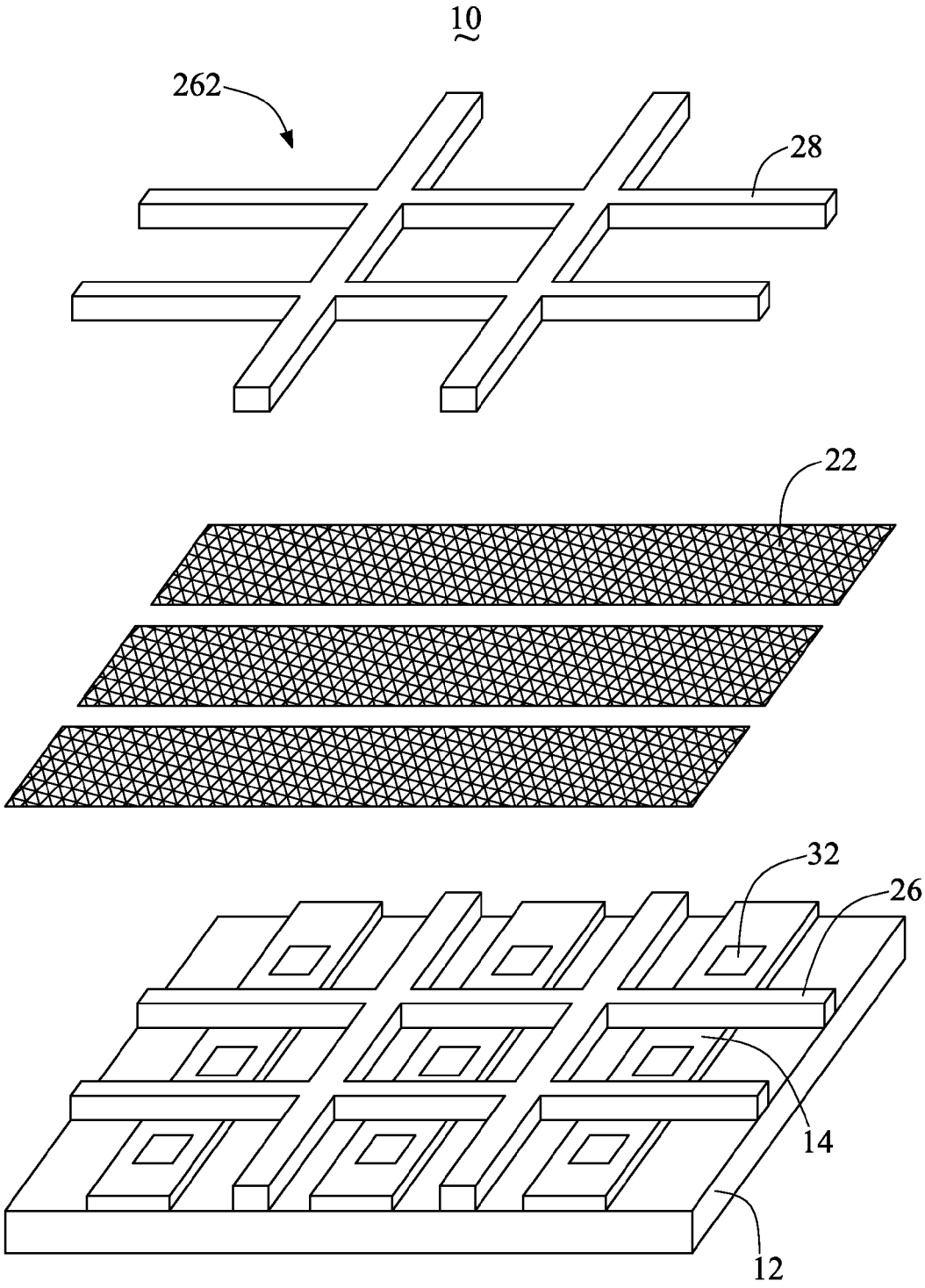
FIG. 1 is a schematic view of a field emission cathode device in accordance with the present embodiment.

Corresponding reference characters indicate corresponding parts throughout the several views. The exemplifications set out herein illustrate at least one embodiment of the present field emission cathode device and field emission display using the same, in one form, and such exemplifications are not to be construed as limiting the scope of the invention in any manner.

DETAILED DESCRIPTION

Reference will now be made to the drawings to describe one embodiment of the present field emission cathode device and a field emission display using the same, in detail.

Figure 2:
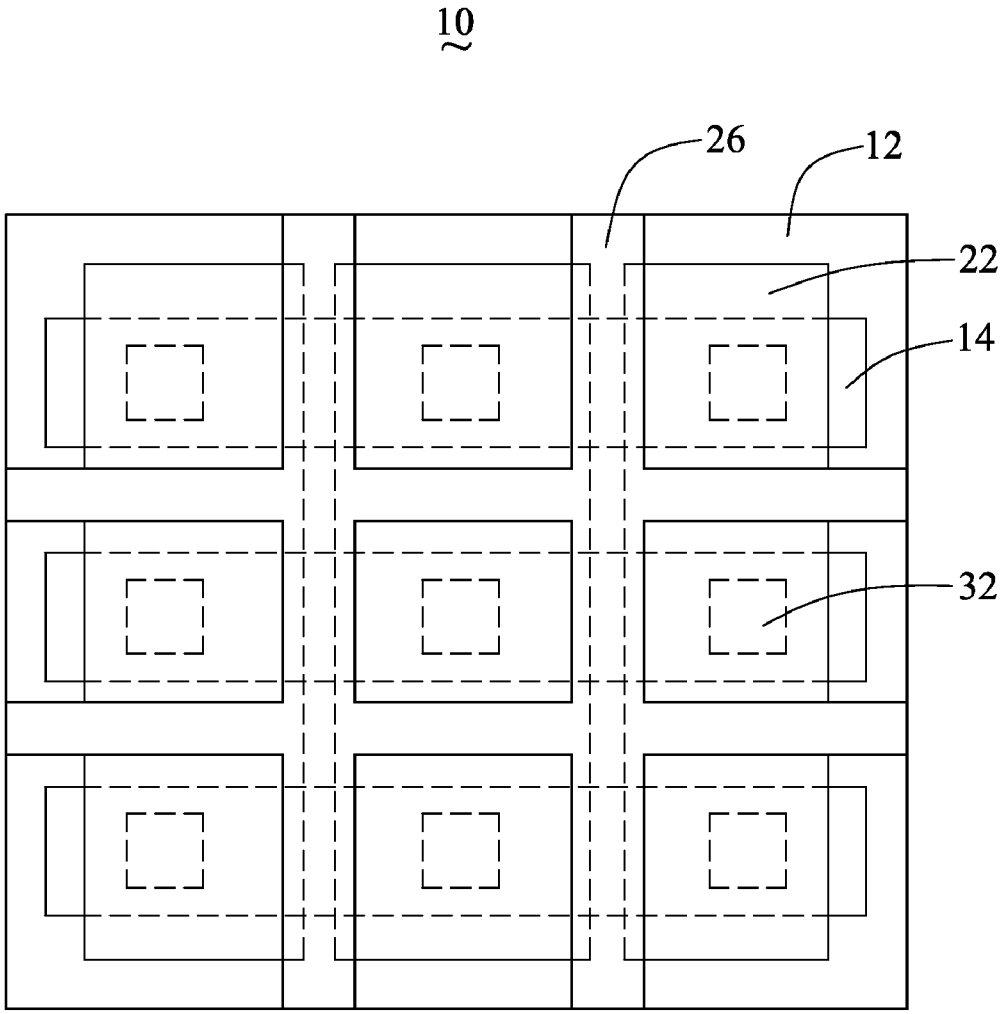
FIG. 2 is a plan view of the field emission cathode device of FIG. 1.

Referring to FIG. 1 and FIG. 2, a field emission cathode device 10 includes an insulating substrate 12, a number of parallel longitudinal cathodes 14, spaced and mounted on the insulating substrate 12, a number of field emission units 32 electrically mounted on the cathodes 14, a bottom dielectric layer portion 26 attached on the insulating substrate 12, a number of strip shaped grids 22 perpendicular to the cathodes 14 in a different plane and distributed on the bottom dielectric layer portion 26, and an upper dielectric layer portion 28 mounted on the grids.

In the present embodiment, the insulating substrate 12 is glass. However other insulating materials, such as silicon dioxide or ceramic, can be used.

The cathodes 14 can be copper, aluminum, gold, silver, indium tin oxide (ITO), or a combination thereof. In the present embodiment, the cathodes 14 are silver.

Each emission unit 32 includes a number of field emitters mounted thereon. While the field emitters can be metal or silicon having sharp tips or carbon nanotubes, in the present embodiment, carbon nanotubes are used. The field emission units 32 are located on the cathodes 14.

The dielectric layer 26 is latticed, consisting of a plurality of perpendicularly intersected strips to define a plurality of voids 262 therein. The dielectric layer 26 is deposed on the insulating substrate 12 and extends across a part of the cathodes 14, such that some parallel strips of the dielectric layer 26 are sandwiched between adjacent cathodes 14 and other strips perpendicular thereto extend across the cathodes 14. Each void 262 corresponds to one field emission unit 32. The dielectric layer is insulating material, such as glass, silicon dioxide, or ceramic. The dielectric layer comprises of a bottom dielectric layer portion 26 and an upper dielectric layer portion 28. The dielectric layer is thicker than 15 μm, in the present embodiment being 20 μm.

The grids 22 are parallel and distributed on the bottom dielectric layer portion 26, separating the bottom dielectric layer portion 26 and upper dielectric layer portion 28 mounted on the grids 22. The bottom dielectric layer portion 26 mounted below the grids 22. The grids 22 are perpendicular to the cathodes 14 in a different plane. Each of the grids 22 covers a number of voids 262 of the bottom dielectric layer portion 26. There can be a plurality of grids 22 that cover corresponding voids 262 of the bottom dielectric layer portion 26. The bottom dielectric layer portion 26 supports the grids 22. The upper dielectric layer portion 26 can fix the grids 22. The grid 22 has a metal mesh with holes structure. The holes have an effective diameter that is equal largest round particle that can pass through. The holes can have an effective diameter that is from 3 μm to 1000 μm with distance between the grids 22 and the cathodes 14 exceeding or equaling 10 μm. In the present embodiment, the grids 22 are stainless steel, with the distance between the grids 22 and the cathodes 14 of about 15 μm.

In operation, different voltages are applied to the cathodes 14 and the grids 22. Generally, the voltage of the cathodes 14 is zero or connected to ground. The voltage of the gate electrodes 22 ranges from ten to several hundred volts (V). The electrons emitted by the field emitter of the field emission units 32 move towards the grids 22 under the influence of the applied electric field induced by the grids 22, and are then emitted through the holes of the mesh. The cathodes 14 are insulated from each other, as are the grids 22. Thus, the field emission currents at different field emission units 32 can easily be modulated by selectively changing the voltages of the grids 22 and the cathodes 14. It is to be understood that the number of cathodes 14 and grids 22 can be set as desired to achieve the proper modulation.

In the field emission cathode device 10, the grids 22 firmly fixed by the dielectric layer portions 26, 28 such that risk of distortion of the grids 22 creating an uneven distance between the grids 22 and the cathodes 14 (resulting uneven emission of the electrons) is prevented. Thus, the electron emission current of the field emission cathode device 10 is uniform. Even if the distance between the grids 22 and the cathodes 14 is relatively short, the grids 22 will not touch the cathodes 14. Therefore, short circuit between the cathodes 14 and the grids 22 is prevented, allowing work voltage of the field emission cathode device 10 to be easily controlled.

Figure 3:
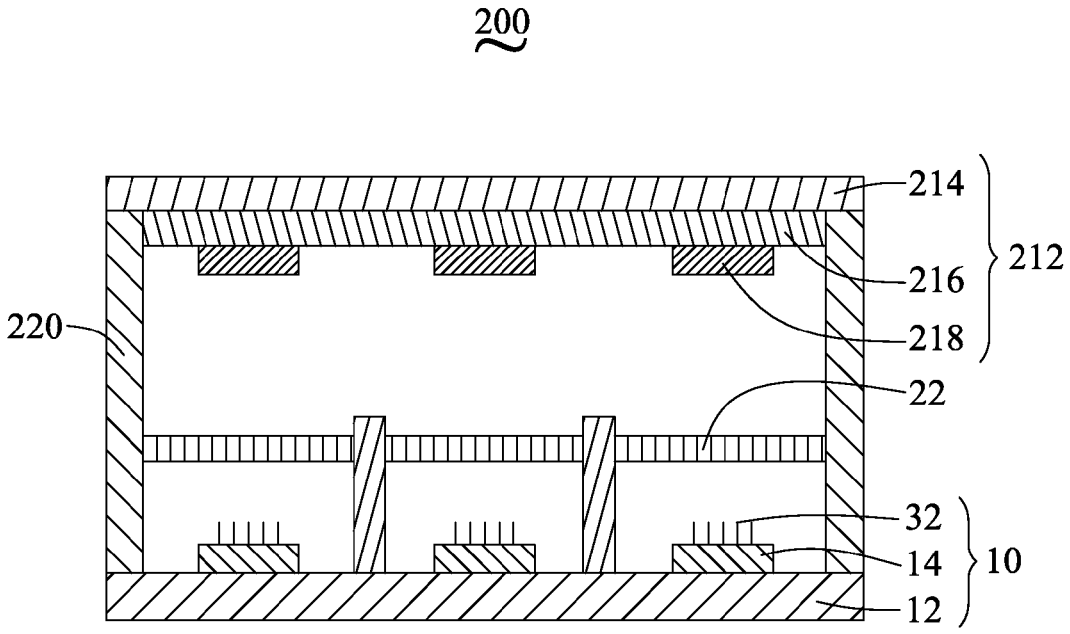
FIG. 3 is a schematic view of a field emission display in accordance with the present embodiment.
Figure 4:
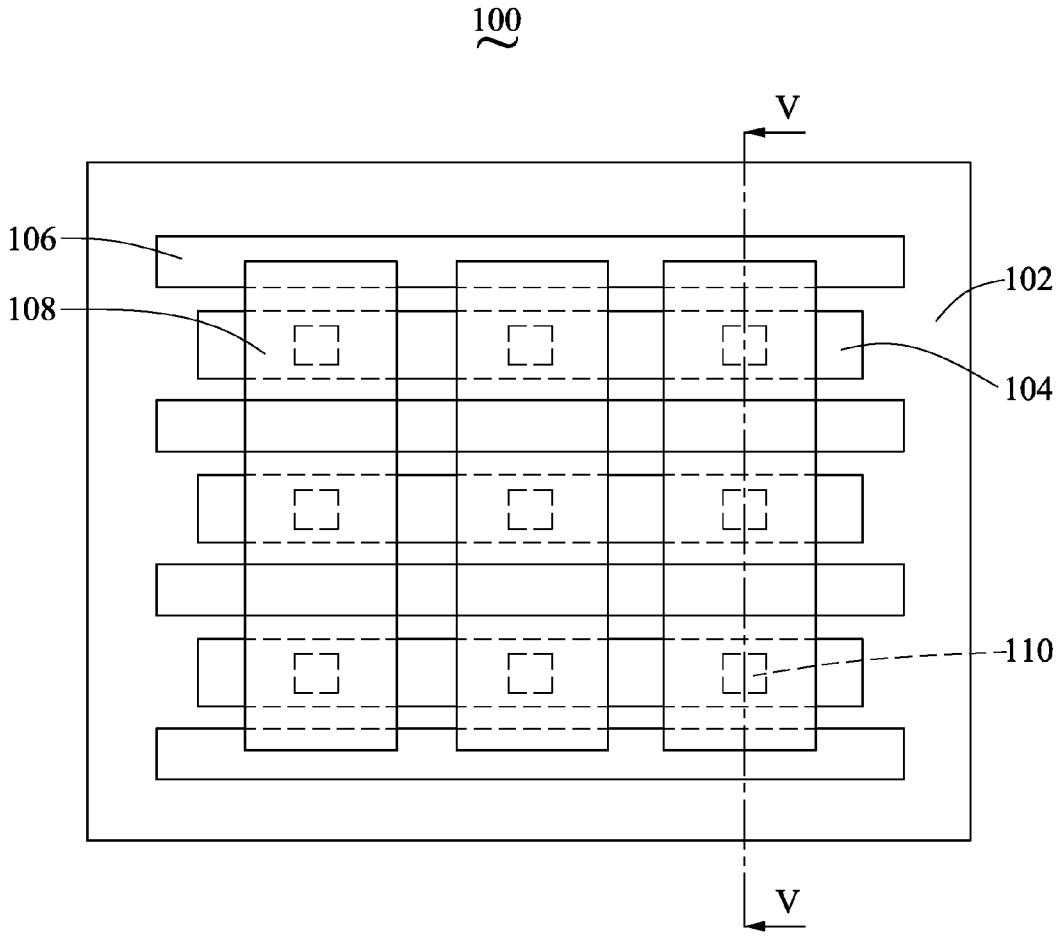
FIG. 4 (PRIOR ART)
FIG. 4 is a plan view of a field emission cathode device according to the prior art.
Figure 5:
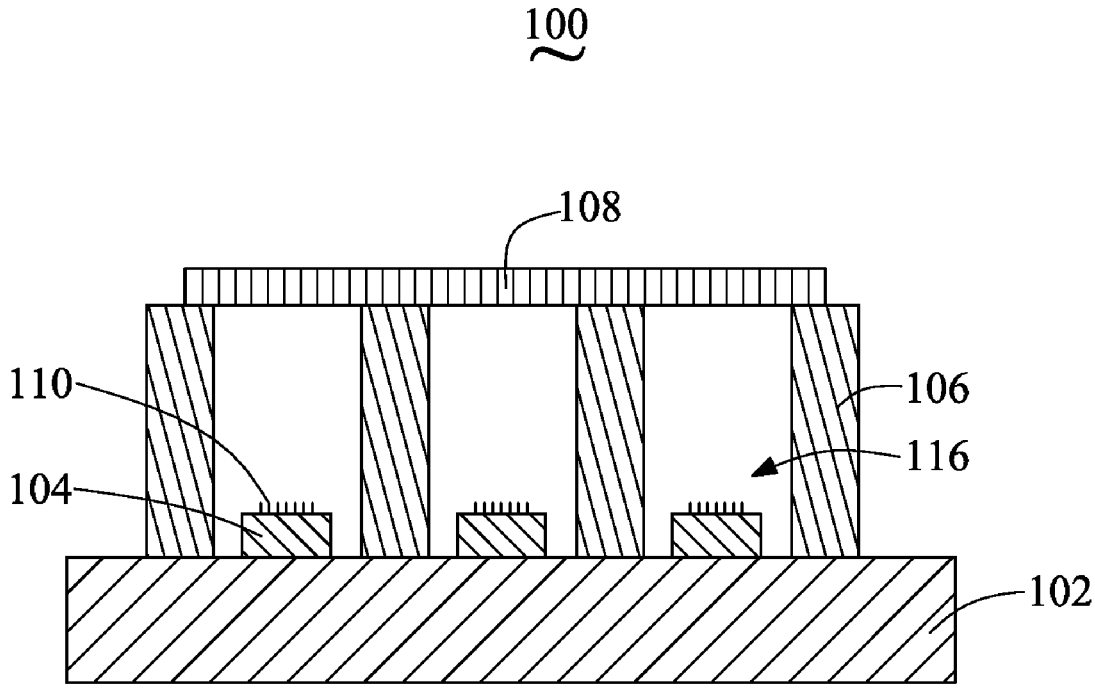
FIG. 5 (PRIOR ART)
FIG. 5 is a cross-section of the field emission cathode device of FIG. 4 taken along a line V-V thereof.

FIG. 3 shows a field emission display 200 using field emission cathode device 10. The field emission display 200 includes an anode electrode device 212 facing field emission cathode device 10.

The distance between the grids 22 and the cathodes 14 exceeds or equals 10 μm.

The anode electrode device 212 of the present embodiment includes a glass substrate 214, a transparent anode 216 disposed on the glass substrate 241, and a phosphor layer 218 spread on the transparent anode 216. An insulated spacer 220 is disposed between the anode electrode device 212 and the substrate 12 to maintain a vacuum seal. The edges of the grids 22 are fixed to the spacer 220. The transparent anode 216 can be an indium tin oxide (ITO) thin film.

In operation, different voltages are applied to the cathodes 14, the grids 22 and the anode 216. Generally, the voltage of the cathodes 14 is zero or connected to ground. The voltage of the gate electrodes 22 is ten to several hundred volts. The electrons emitted by the field emitter of the field emission units 32 move towards the grids 22 under the influence of the applied electric field induced by the grids 22, and are then emitted through the meshes of the grids 22. Finally the electrons reach the anode 216 under the electric field induced by the anode 216 and collide with the phosphor layer 218 located on the transparent anode 216. The phosphor layer 218 then emits visible light to accomplish display function of the field emission display 200. The cathodes 14 are insulated from each other, as are grids 22. Thus, field emission currents at different field emission units 32 can be easily modulated by selectively changing the voltages of the grids 22 and the cathodes 14.

While the invention has been described by way of example and in terms of preferred embodiment, it is to be understood that the invention is not limited thereto. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A field emission cathode device, comprising:

an insulating substrate;

a plurality of cathodes mounted on the insulating substrate;

a plurality of field emission units mounted on the cathodes;

a dielectric layer consisting of an upper section dielectric layer and a lower section dielectric layer, and the lower section dielectric layer disposed on the insulating substrate, and the lower section dielectric layer defining a plurality of voids corresponding to the field emission units; and a plurality of grids disposed between the upper section dielectric layer and the lower section dielectric layer, and wherein each grid is secured by the upper section dielectric layer and the lower section dielectric layer, and the plurality of grids extends over the plurality of voids.

2. The field emission cathode device as claimed in claim 1, wherein the field emission units are located in the voids.

3. The field emission cathode device as claimed in claim 2, wherein the dielectric layer is mounted on the cathodes.

4. The field emission cathode device as claimed in claim 3, wherein the lower section dielectric layer comprises a plurality of substantially perpendicularly intersecting strips defining the voids therein, and the lower section dielectric layer intersects with each of the cathodes.

5. The field emission cathode device as claimed in claim 4, wherein the cathodes are substantially parallel to each other, and some strips of the dielectric layer are substantially parallel to cathodes and other strips of the dielectric layer are substantially perpendicular to the cathodes.

6. The field emission cathode device as claimed in claim 2, wherein the grids are spaced from the field emission units.

7. The field emission cathode device as claimed in claim 6, wherein each of the plurality of comprises a mesh defining a plurality of holes, and each of the plurality of holes has an effective diameter in a range of about 3 μm to about 1000μm.

8. The field emission cathode device as claimed in claim 6, wherein the grids are strip shaped, and the grids are substantially parallel to and spaced from each other.

9. The field emission cathode device as claimed in claim 2, wherein a thickness of the dielectric layer is greater than or equal to 15 μm.

10. The field emission cathode device as claimed in claim 2, wherein a distance between the grids and cathodes is greater than or equal to 10 μm.

11. The field emission cathode device as claimed in claim 2, wherein the field emission units are electrically mounted on the cathodes, and each field emission unit comprises a plurality of field emitters.

12. The field emission cathode device as claimed in claim 11, wherein the plurality of field emitters is metal having sharp tips, silicon having sharp tips, or carbon nanotubes.

13. The field emission cathode device as claimed in claim 2, wherein the dielectric layer is an insulator, made of a material selected from the group consisting of glass, silicon dioxide, and ceramic.

14. A field emission display, comprising:

a field emission cathode device comprising an insulating substrate; a plurality of cathodes mounted on the insulating substrate; and a plurality of field emission units mounted on the cathodes;

a dielectric layer consisting of an upper section dielectric layer and a lower section dielectric layer, and the lower section dielectric layer located on the insulating substrate and defining a plurality of voids corresponding to the field emission units;

a plurality of grids disposed between the upper section dielectric layer and the lower section dielectric layer, wherein each grid is secured by the upper section dielectric layer and the lower section dielectric layer, and the plurality of grids extends over the plurality of voids; and an anode electrode device, wherein the anode electrode device and the grids have a distance therebetween.

15. The field emission display as claimed in claim 14, wherein the anode electrode device comprises a glass substrate, a transparent anode located on the glass substrate, and a phosphor layer spread on the transparent anode.

16. The field emission display as claimed in claim 14, further comprising an insulated spacer located between the anode electrode device and the insulating substrate to establish a vacuum seal.

17. The field emission display as claimed in claim 14, wherein a distance between the grids and the cathodes exceeds or equals 10 μm.

18. The field emission display as claimed in claim 14, wherein each of the plurality of grids comprises a mesh defining a plurality of holes, and each of the plurality of voids corresponds to more than one hole.

19. A field emission cathode device, comprising:

an insulating substrate;

a plurality of cathodes located on the insulating substrate;

a plurality of field emission units located on the cathodes;

a dielectric layer located on the insulating substrate and defining a plurality of voids corresponding to the field emission units; and a plurality of grids inserted into the dielectric layer to divide the dielectric layer to form an upper section dielectric layer and a lower section dielectric layer, wherein each grid is secured by the upper section dielectric layer and the lower section dielectric layer, each grid being a mesh defining a plurality of holes, each of the plurality of voids corresponding to more than one hole.

20. The field emission cathode device as claimed in claim 19, wherein the lower section dielectric layer defines a plurality of bottom voids, and the plurality of grids extends over the plurality of bottom voids.

* * * * *